US007857403B2

(12) United States Patent
Chen et al.

(10) Patent No.: US 7,857,403 B2
(45) Date of Patent: Dec. 28, 2010

(54) RETAINING MECHANISM FOR A MULTI-SECTION SLIDE TRACK ASSEMBLY

(75) Inventors: Ken-Ching Chen, Kaohsiung Hsien (TW); Shih-Long Hwang, Kaohsiung Hsien (TW); Shun-Ho Yang, Kaohsiung Hsien (TW); Chun-Chiang Wang, Kaohsiung Hsien (TW)

(73) Assignee: King Slide Works, Co., Ltd., Kaohsiung Hsien (TW)

( * ) Notice: Subject to any disclaimer, the term of this patent is extended or adjusted under 35 U.S.C. 154(b) by 106 days.

(21) Appl. No.: 12/401,352

(22) Filed: Mar. 10, 2009

(65) Prior Publication Data

US 2009/0169140 A1 Jul. 2, 2009

Related U.S. Application Data

(62) Division of application No. 11/350,735, filed on Feb. 10, 2006, now Pat. No. 7,520,577.

(30) Foreign Application Priority Data

Jun. 24, 2005 (TW) ..... 94121442 A

(51) Int. Cl.
*A47B 88/04* (2006.01)

(52) U.S. Cl. ..... 312/334.46; 312/333; 384/21

(58) Field of Classification Search ..... 312/330.1, 312/333, 334.1, 334.7, 334.8, 334.11, 334.44, 312/334.46, 334.47; 384/18, 21, 22
See application file for complete search history.

(56) References Cited

U.S. PATENT DOCUMENTS 3,133,768 A 5/1964 Klakovich
3,258,299 A 6/1966 Meyer
3,371,968 A 3/1968 Loake
3,589,778 A 6/1971 Olson
3,650,578 A 3/1972 Del Vecchio et al.
4,560,212 A 12/1985 Papp et al.
4,998,828 A 3/1991 Hobbs
5,417,490 A 5/1995 Hobbs et al.
5,484,197 A 1/1996 Hansen et al.
5,551,775 A 9/1996 Parvin
5,757,109 A 5/1998 Parvin
5,871,265 A 2/1999 Stewart et al.
6,296,338 B1 10/2001 Stijns
6,350,001 B1 2/2002 Chu
6,390,574 B2 5/2002 Fraccaro (Continued)

*Primary Examiner*—James O Hansen
(74) *Attorney, Agent, or Firm*—Muncy, Geissler, Olds & Lowe, PLLC

(57) ABSTRACT

A retaining mechanism for a multi-section slide track assembly includes a stop actuating assembly and a resilient retainer assembly. The stop actuating assembly is provided on an intermediate slide track of the multi-section slide track assembly while the resilient retainer assembly is provided on an outer slide track of the multi-section slide track assembly. To retain a return movement of the intermediate slide track, the stop actuating assembly is directly engaged with the resilient retainer assembly to provide a high-degree effective operation of retaining reliability. The stop actuating assembly includes a stop-engaging member and a resiliently actuating member combined therewith. The resilient retainer assembly correspondingly includes a resilient stop member which can be engaged with the stop-engaging member for positioning the intermediate slide track, and can be actuated by the resiliently actuating member for releasing the intermediate slide track.

7 Claims, 13 Drawing Sheets

U.S. PATENT DOCUMENTS

| | | | | |
|---|---|---|---|---|
| 6,450,600 | B1 | 9/2002 | Chen et al. | |
| 6,585,335 | B2 | 7/2003 | Hwang et al. | |
| 6,655,763 | B2 | 12/2003 | Judge et al. | |
| 6,702,412 | B2 | 3/2004 | Dobler et al. | |
| 6,705,689 | B2 | 3/2004 | Chen et al. | |
| 6,749,276 | B2 | 6/2004 | Judge et al. | |
| 6,805,418 | B2 | 10/2004 | Milligan | |
| 6,899,408 | B2 | 5/2005 | Chen et al. | |
| 6,997,611 | B2 * | 2/2006 | Chen et al. | 384/21 |
| 7,008,030 | B2 | 3/2006 | Yang | |
| 7,118,277 | B2 * | 10/2006 | Chen et al. | 384/21 |
| 2003/0052580 | A1 | 3/2003 | Dobler et al. | |
| 2003/0111942 | A1 | 6/2003 | Judge et al. | |
| 2004/0174103 | A1 | 9/2004 | Yang | |
| 2004/0239220 | A1 | 12/2004 | Yang | |
| 2005/0116594 | A1 | 6/2005 | Barry, Jr. et al. | |
| 2005/0180667 | A1 | 8/2005 | Chen et al. | |

* cited by examiner

RETAINING MECHANISM FOR A MULTI-SECTION SLIDE TRACK ASSEMBLY

This application is a Divisional of application Ser. No. 11/350,735, filed on Feb. 10, 2006, now U.S. Pat. No. 7,520,577 and for which priority is claimed under 35 U.S.C. §120; the entire contents of which are hereby incorporated by reference.

BACKGROUND OF THE INVENTION

1. Field of the Invention

The present invention relates to a retaining mechanism for a multi-section slide track assembly. Particularly, the present invention relates to the retaining mechanism for use in a three-section slide track assembly. More particularly, the present invention relates to the retaining mechanism for limiting a return movement of an intermediate slide track with respect to an outer slide track in drawing-out operation, and for automatically disengaging the intermediate slide track from the outer slide track in retracting operation.

2. Description of the Related Art

In general, many drawers or load-carrying components are often equipped with multi-section slide track assemblies which are usually mounted in a computer cabinet or a rack. Accordingly, the drawers or the load-carrying components can be slidably drawn out or retracted into the computer cabinet or rack. There are two major categories of the multi-section slide track assemblies. A first category includes a two-section slide track assembly that has a basic structure consisting of an inner slide track and an outer slide track. On the other hand, a second category includes a three-section slide track assembly that has a basic structure consisting of an inner slide track, an intermediate slide track and an outer slide track. In use, there is a need for disassembling the inner slide track from the outer slide track for factory workers or do-it-yourself users for example. The conventional multi-section slide track assembly is usually designed to provide with a common function of removing the inner slide track from the other slide tracks.

With regard to the second category, firstly, the three-section slide track assembly involves the significant problem of smoothly sliding movement (i.e. telescopic movement) among the inner slide track, the intermediate slide track and the outer slide track. Secondly, the three-section slide track assembly involves the significant problem of ease of assembling, disassembling and reassembling the inner slide track, the intermediate slide track and the outer slide track. Thirdly, the three-section slide track assembly involves the significant problem of positioning and retaining among the inner slide track, the intermediate slide track and the outer slide track.

Other commonly assigned U.S. patents and pending U.S. patent applications disclose the three-section slide track assembly. For example, related U.S. patents include U.S. Pat. No. 3,133,768, entitled "EXTENSIBLE CHASSIS SLIDE," U.S. Pat. No. 3,258,299, entitled "SLIDING SUPPORT WITH ADJUSTABLE SHOCK BLOCK," U.S. Pat. No. 3,371,968, entitled "EXTENSION SLIDE," U.S. Pat. No. 3,589,778, entitled "CABINET DRAWER SLIDE ASSEMBLY," U.S. Pat. No. 3,650,578, entitled "QUICK DISCONNECT SLIDE STRUCTURE," U.S. Pat. No. 4,560,212, entitled "THREE PART BALL BEARING SLIDE WITH LOCKABLE INTERMEDIATE SLIDE MEMBER," U.S. Pat. No. 4,998,828, entitled "OVER AND UNDER TELESCOPE SLIDE ASSEMBLY," U.S. Pat. No. 5,417,490, entitled "TELESCOPING SLIDE ASSEMBLY," U.S. Pat. No. 5,484,197, entitled "RELEASABLE LATCH FOR A TELESCOPING SLIDE ASSEMBLY," U.S. Pat. No. 5,551,775, entitled "TELESCOPIC DRAWER SLIDE WITH MECHANICAL SEQUENCING LATCH," U.S. Pat. No. 5,757,109, entitled "TELESCOPIC DRAWER SLIDE WITH SOFT SEQUENCING LATCH," U.S. Pat. No. 5,871,265, entitled "TWO-WAY SLIDE," U.S. Pat. No. 6,296,338, entitled "TELESCOPIC RAIL HAVING CONTROLLABLE POSITIONING," U.S. Pat. No. 6,350,001, entitled "SLIDING TRACK ASSEMBLY FOR DRAWER," U.S. Pat. No. 6,390,574, entitled "FULLY EXTENDIBLE DRAWER UNIT AND COUPLING," U.S. Pat. No. 6,585,335, entitled "REAR-SECTION BOLT LOCK STRUCTURE OF A SLIDE," U.S. Pat. No. 6,655,763, entitled "CONTROLLER FOR A QUICK DISCONNECT SLIDE ASSEMBLY," U.S. Pat. No. 6,702,412, entitled "EXPANDABLE SLIDE AND RAIL ASSEMBLY FOR A RACK AND METHOD OF INSTALLING SAME," U.S. Pat. No. 6,705,689, entitled "TRACK DEVICE ALLOWING SEQUENTIAL INWARD MOVEMENT," U.S. Pat. No. 6,749,276, entitled "SEQUENCING MECHANISM FOR SLIDE ASSEMBLY," U.S. Pat. No. 6,805,418, entitled "FRICTION DRAWER SLIDE," and U.S. Pat. No. 6,899,408, entitled "TRACK DEVICE FOR A DRAWER." Particularly, U.S. Pat. Nos. 6,585,335, 6,705,689, and 6,899,408 are owned by the present assignee. Each of these U.S. patents is incorporated herein by reference for purposes including, but not limited to, indicating the background of the present invention and illustrating the state of the art.

For example, related U.S. patent application publications include Pub. No. US 2003/0052580, entitled "SNAP-ON SLIDE AND RAIL ASSEMBLY AND METHOD OF ASSEMBLING SAME," Pub. No. US 2003/0111942, entitled "FRONT RELEASE FOR A SLIDE ASSEMBLY," Pub. No. US 2004/0174103, entitled "UNDETACHABLE DRAWER RAIL," Pub. No. US 2004/0239220, entitled "LOW PROFILE LOCK WITH FRONT RELEASE FOR A DRAWER SLIDE," Pub. No. US 2005/0116594, entitled "SLIDE RAIL HAVING FRONT RELEASE LATCH," and Pub. No. US 2005/0180667, entitled "POSITIONING DEVICE FOR A MULTI-SECTION SLIDE TRACK ASSEMBLY OF DRAWERS." Particularly, U.S. Patent Application Publication No. US 2005/0180667 is owned by the present assignee. Each of these U.S. patent publications is incorporated herein by reference for purposes including, but not limited to, indicating the background of the present invention and illustrating the state of the art.

A conventional retaining mechanism, as described in U.S. Pat. No. 6,899,408 and U.S. Patent Application Publication No. 2005/0180667, describes a stop structure integrally formed on one of slide tracks of the multi-section slide track assembly. In general, the multi-section slide track assembly is made from a relatively soft metal material which cannot withstand unusual impact of components of a retaining mechanism against on the multi-section slide track assembly in use. Because of this, there is a need for a heat treatment on the multi-section slide track assembly for extra strength and rigidity of the stop structure. Inevitably, a number of limitations exist for the multi-section slide track assembly due to (1) difficulties in heat treating the entire assembly; (2) increasing total manufacture cost (i.e. production cost) for heat treating operation; and (3) causing distortion of components of the multi-section slide track assembly in heat treating operation or cooling operation.

With regard to the problematic aspects naturally occurring during use of the soft metal material of the stop structure, the multi-section slide track assembly is susceptible to a number of problems, including: (1) a low possibility of intensifying the strength and rigidity of the stop structure; (2) a high possibility of occurring component abrasion of the stop structure or causing the retaining mechanism scraping against the multi-section slide track assembly; and (3) loss in the retaining function of the stop structure due to component impact during prolonged use.

The present invention intends to provide a retaining mechanism for a multi-section slide track assembly, wherein the retaining mechanism includes a stop actuating assembly and a resilient retainer assembly. The stop actuating assembly is provided on an intermediate slide track of the multi-section slide track assembly while the resilient retainer assembly is provided on an outer slide track of the multi-section slide track assembly. To retain a return movement of the intermediate slide track, the stop actuating assembly is directly engaged with the resilient retainer assembly to provide a high-degree effective operation of retaining reliability in such a way as to mitigate and overcome the above problem.

SUMMARY OF THE INVENTION

The primary objective of this invention is to provide a retaining mechanism for a multi-section slide track assembly, wherein a stop actuating assembly is directly engaged with a resilient retainer assembly. No part or portion of the multi-section slide track assembly is employed to engage with the retaining mechanism so as to extend the useful life of the multi-section slide track assembly. Accordingly, the multi-section slide track assembly can be made from a low manufacture-cost material.

The secondary objective of this invention is to provide the retaining mechanism for the multi-section slide track assembly, wherein components of the stop actuating assembly and the resilient retainer assembly are individually made from a high strength metal for extra strength and rigidity. Accordingly, the retaining mechanism can be selectively made from a suitable rigid material which is helpful in maintaining a retaining function during long-term use.

Another objective of this invention is to provide the retaining mechanism for the multi-section slide track assembly, wherein each separate components of the retaining mechanism can be adjusted, repaired or replaced during long-term use. Accordingly, the separate components of the retaining mechanism can be easily adjusted, repaired or replaced at a low maintenance cost due to no need for replacing the entire retaining mechanism.

Another objective of this invention is to provide the retaining mechanism for the multi-section slide track assembly, wherein the retaining mechanism includes a plurality of elastic members constructed from leaf springs or the likes having different thickness to provide various spring rates (i.e. high spring rate, semi-high spring rate, semi-low spring rate etc.). Accordingly, the elastic members of the retaining mechanism can be designed to provide various spring rates.

The retaining mechanism in accordance with an aspect of the present invention includes a stop actuating assembly and a resilient retainer assembly. The stop actuating assembly is provided on an intermediate slide track of the multi-section slide track assembly while the resilient retainer assembly is provided on an outer slide track of the multi-section slide track assembly. To retain a return movement of the intermediate slide track, the stop actuating assembly is directly engaged with the resilient retainer assembly to provide a high-degree effective operation of retaining reliability. The stop actuating assembly includes a stop-engaging member and a resiliently actuating member combined therewith. The resilient retainer assembly correspondingly includes a resilient stop member which can be engaged with the stop-engaging member for positioning the intermediate slide track, and can be actuated by the resiliently actuating member for releasing the intermediate slide track.

In a separate aspect of the present invention, the resilient retainer assembly further includes a fixing member for mounting the resilient stop member on the outer slide track.

In a further separate aspect of the present invention, the resilient retainer assembly further includes a limit member to confine an upward movement of the resilient stop member.

In a yet further separate aspect of the present invention, the resilient retainer assembly is further provided with a resilient arm for exerting an upward spring force on the resilient stop member such that the resilient stop member is tightly engaged with the limit member.

In a yet further separate aspect of the present invention, the resilient arm of the resilient retainer assembly is formed on the limit member.

In a yet further separate aspect of the present invention, the resilient arm of the resilient retainer assembly is formed on the resilient stop member.

In a yet further separate aspect of the present invention, the limit member of the resilient retainer assembly is integrally formed on the intermediate slide track.

In a yet further separate aspect of the present invention, the intermediate slide track further includes a pair of upraised protrusions adjacent to the limit member so that the limit protrusions can limit any lateral movement of the resilient stop member.

Further scope of the applicability of the present invention will become apparent from the detailed description given hereinafter. However, it should be understood that the detailed description and specific examples, while indicating preferred embodiments of the invention, are given by way of illustration only, since various will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
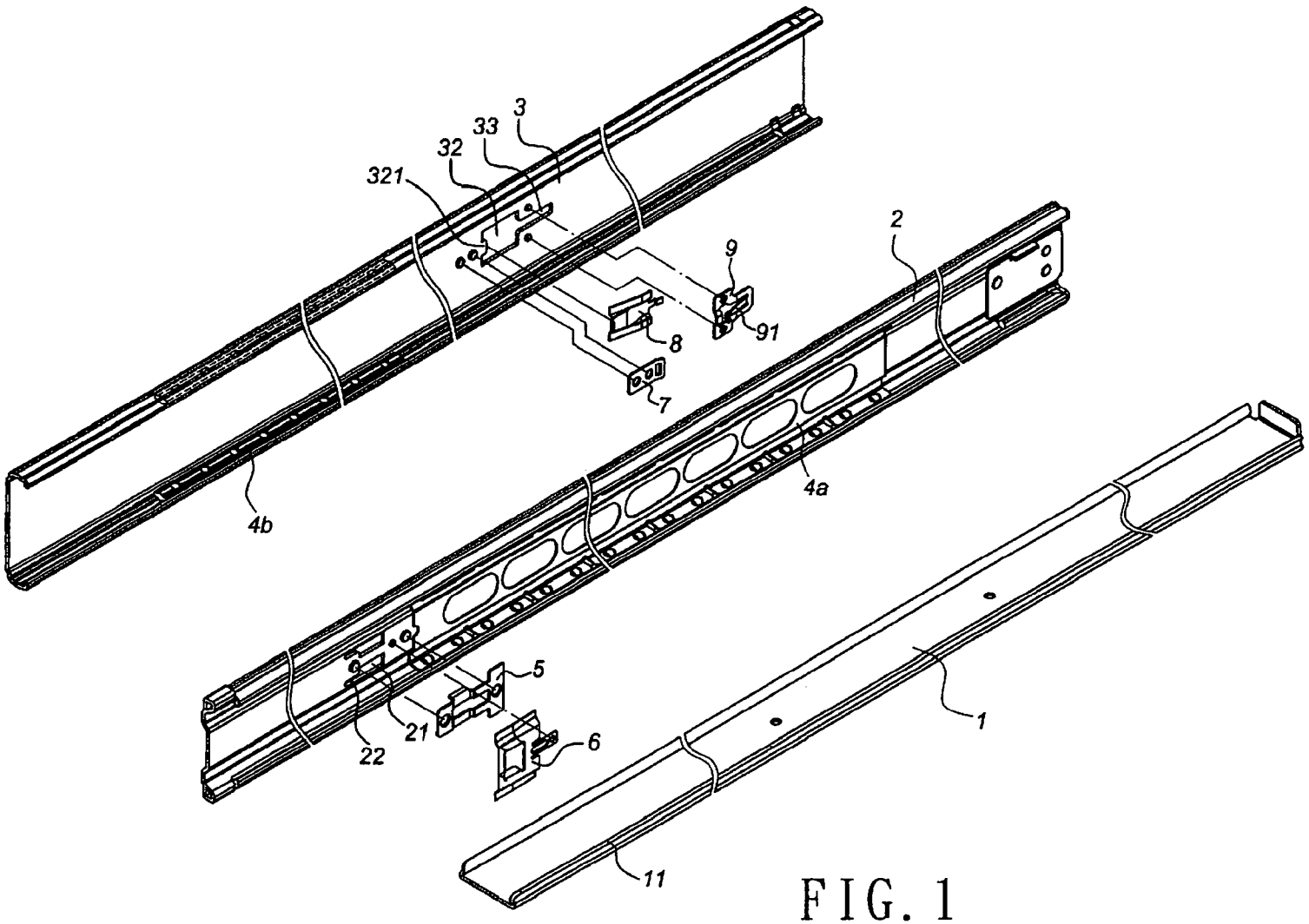
FIG. 1 is an exploded perspective view illustrating a retaining mechanism and a multi-section slide track assembly in accordance with a first embodiment of the present invention.

Referring now to FIG. 1, an exploded perspective view of a retaining mechanism and a multi-section slide track assembly in accordance with a first embodiment of the present invention is illustrated. The multi-section slide track assembly is constructed from a three-section slide track assembly that consists of an inner slide track designated numeral 1, an intermediate slide track designated numeral 2, an outer slide track designated numeral 3, a first ball-bearing member designated numeral 4*a* and a second ball-bearing member designated numeral 4*b*. In assembling, the first ball-bearing member 4*a* is sandwiched in-between the inner slide track 1 and the intermediate slide track 2 for permitting sliding movements between the inner slide track 1 and the intermediate slide track 2. Similarly, the second ball-bearing member 4*b* is sandwiched in-between the intermediate slide track 2 and the outer slide track 3 for permitting sliding movements between the intermediate slide track 2 and the outer slide track 3. In the following embodiments, constructions of the multi-section slide track assembly in detail shall be omitted.

Still referring to FIG. 1, the retaining mechanism in accordance with the first embodiment of the present invention includes a stop actuating assembly and a resilient retainer assembly. In the illustrated first embodiment, the stop actuating assembly is provided on the intermediate slide track 2 of the multi-section slide track assembly while the resilient retainer assembly is provided on the outer slide track 3 of the multi-section slide track assembly. In retaining operation, the stop actuating assembly is directly engaged with the resilient retainer assembly to provide a high-degree effective operation of retaining reliability. In this manner an unwanted return movement of the intermediate slide track can be avoided.

Figure 2:
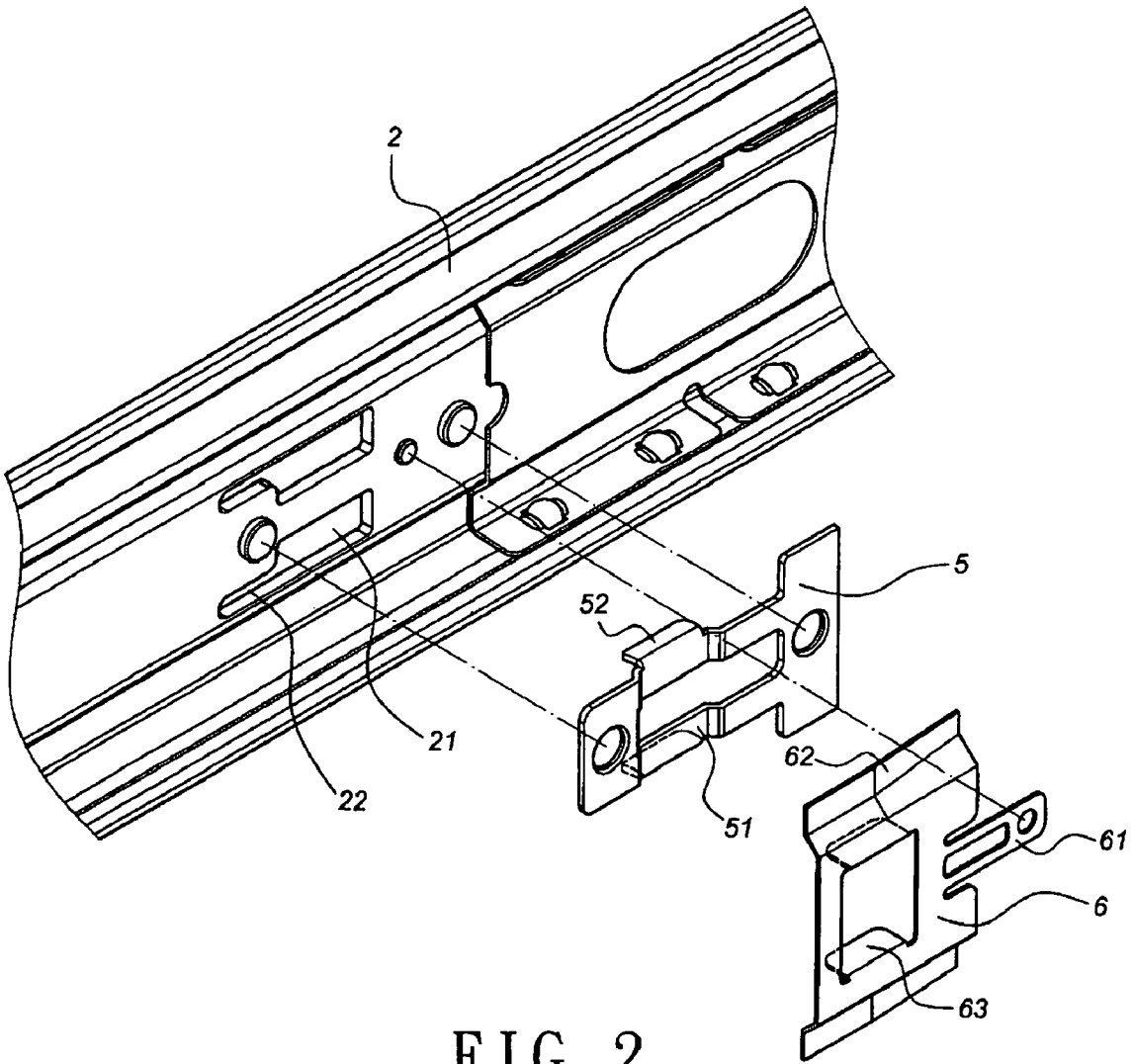
FIG. 2 is an exploded, enlarged perspective view illustrating a stop actuating assembly of the retaining mechanism for use in the multi-section slide track assembly in accordance with the first embodiment of the present invention.
Figure 3:
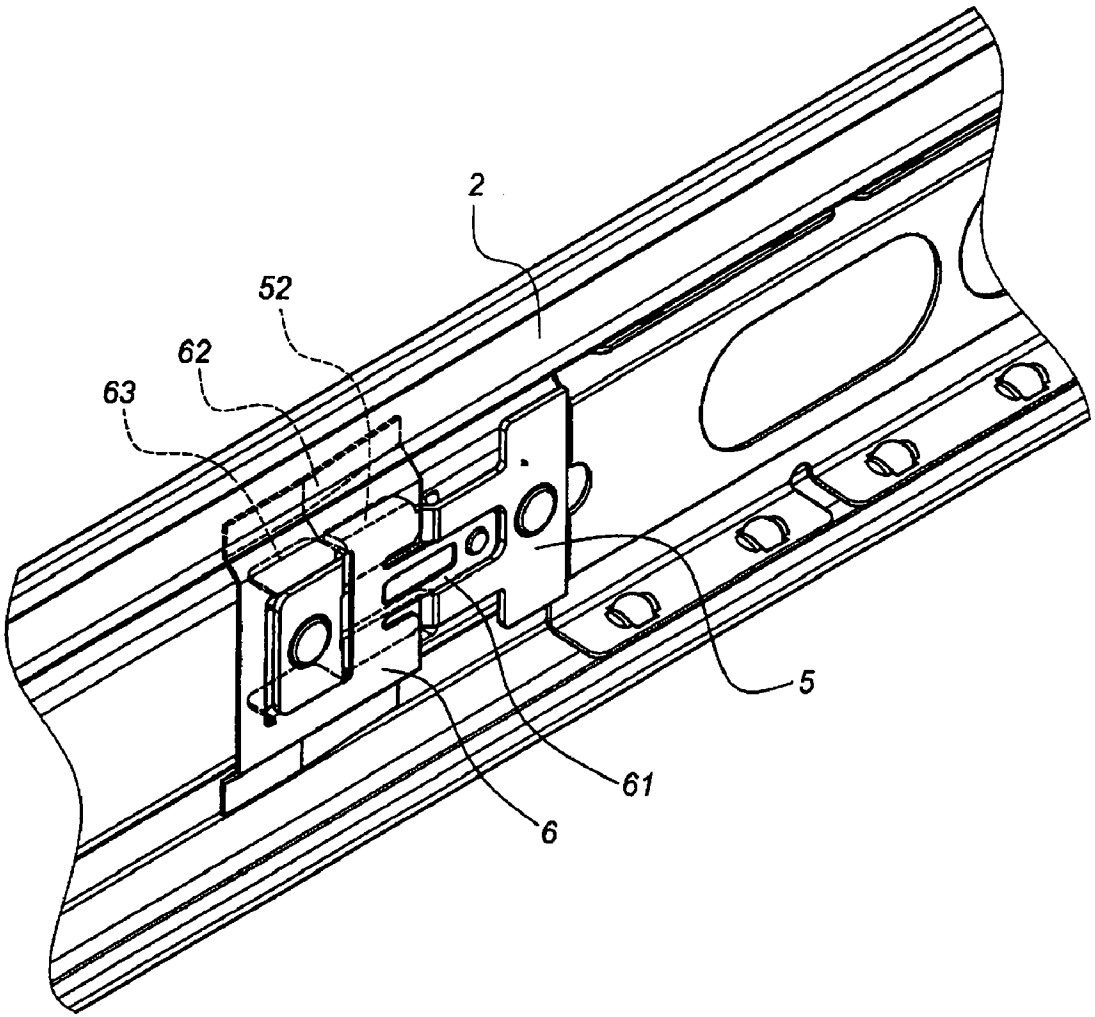
FIG. 3 is an assembled, enlarged perspective view illustrating the stop actuating assembly of the retaining mechanism mounted on the multi-section slide track assembly in accordance with the first embodiment of the present invention.

Turning now to FIGS. 2 and 3, exploded and assembled perspective views of the stop actuating assembly of the retaining mechanism for use in the multi-section slide track assembly in accordance with the first embodiment of the present invention are illustrated. In a preferred embodiment, the intermediate slide track 2 has a pair of corresponding operation windows 21 which are formed on predetermined positions of the intermediate slide track 2 where the stop actuating assembly is installed, as best shown in FIG. 2. Each of the operation windows 21 includes a neck portion 22 provided with a relatively narrow width.

Constructions of the stop actuating assembly in the first embodiment shall be described in detail with reference to FIGS. 2 and 3. In the first embodiment, the stop actuating assembly includes a stop-engaging member 5 and a resiliently actuating member 6 which are mounted on the intermediate slide track 2 by using fasteners, such as rivets, screws or equivalent attachment structures. Preferably, the stop-engaging member 5 is constructed from a one-piece metal member which includes a pair of thin recess sections 51, and a pair of engaging lugs 52. In another preferred embodiment, the stop-engaging member 5 is made from a sheetmetal which is relatively rigid and strong to withstand normal usage of the sliding movements of the multi-section slide track assembly. The thin recess sections 51 have two opposite outer edges each connecting with the engaging lug 52 which is correspondingly bent on the associated outer edge of the thin recess section 51. In a preferred embodiment, the thin recess sections 51 and the engaging lugs 52 are integrally formed in a single punching or bending operation such that no other bending operation is required.

By referring particularly to FIG. 3, in assembling, each of distal ends of the stop-engaging member 5 is fixed on either end side of the operation window 21 of the intermediate slide track 2. In the first embodiment, each of the engaging lugs 52 is extended through the operation window 21 of the intermediate slide track 2 while each of the thin recess sections 51 is received in the associated operation window 21 of the intermediate slide track 2. In this manner, the engaging lugs 52 of the stop actuating assembly are extended along a direction running to the outer slide track 3 so that they can engage with the resilient retainer assembly provided on the outer slide track 3.

Still referring to FIGS. 2 and 3, the resiliently actuating member 6 is also preferably constructed from a one-piece metal member which includes a resilient arm 61, a pair of pressing guide edges 62, and a pair of actuating lugs 63. In a preferred embodiment, the resiliently actuating member 6 is made from a sheetmetal which is relatively rigid and strong to withstand normal usage of the sliding movements of the multi-section slide track assembly. The resilient arm 61 is extended from the resiliently actuating member 6 to provide a high-degree spring force itself. If a higher or lower spring force is desired, dimensions of the resilient arm 61 can be redesigned. The resiliently actuating member 6 has two opposite outer edges each connecting with the pressing guide edges 62 which is correspondingly bent on the associated outer edge. The resiliently actuating member 6 further includes an aperture in which to provide the actuating lugs 63. In a preferred embodiment, the resilient arm 61, the pressing guide edges 62, and the actuating lugs 63 are integrally formed in a single punching or bending operation such that no other bending operation is required.

By referring particularly to FIG. 3, in assembling, the resilient arm 61 is fixed on one of the end side of the operation window 21 of the intermediate slide track 2, thereby permitting a resiliently upraised movement of the resiliently actuating member 6 on the intermediate slide track 2. In the first embodiment, each of the actuating lugs 63 is extended into the associated neck portion 22 of the operation window 21 of the intermediate slide track 2 while the resiliently actuating member 6 is stacked on the stop-engaging member 5 which has been mounted on the intermediate slide track 2. Once assembled, the pressing guide edges 62 can be pressed by the inner slide track 1 so that the actuating lugs 63 of the stop-engaging member 5 can actuate the resilient retainer assembly for releasing engagement.

Figure 4:
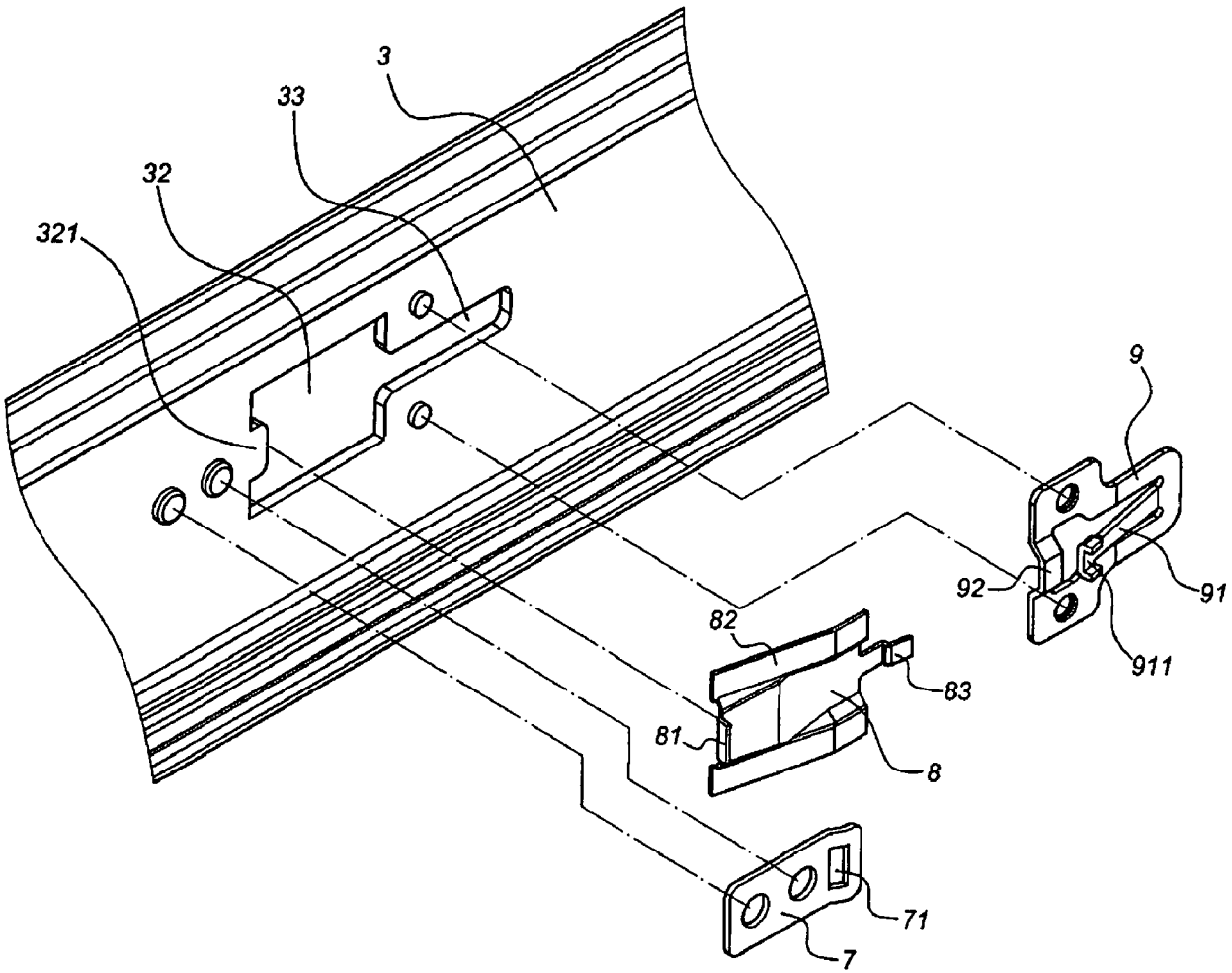
FIG. 4 is an exploded, enlarged perspective view illustrating a resilient retainer assembly of the retaining mechanism for use in the multi-section slide track assembly in accordance with the first embodiment of the present invention.
Figure 5:
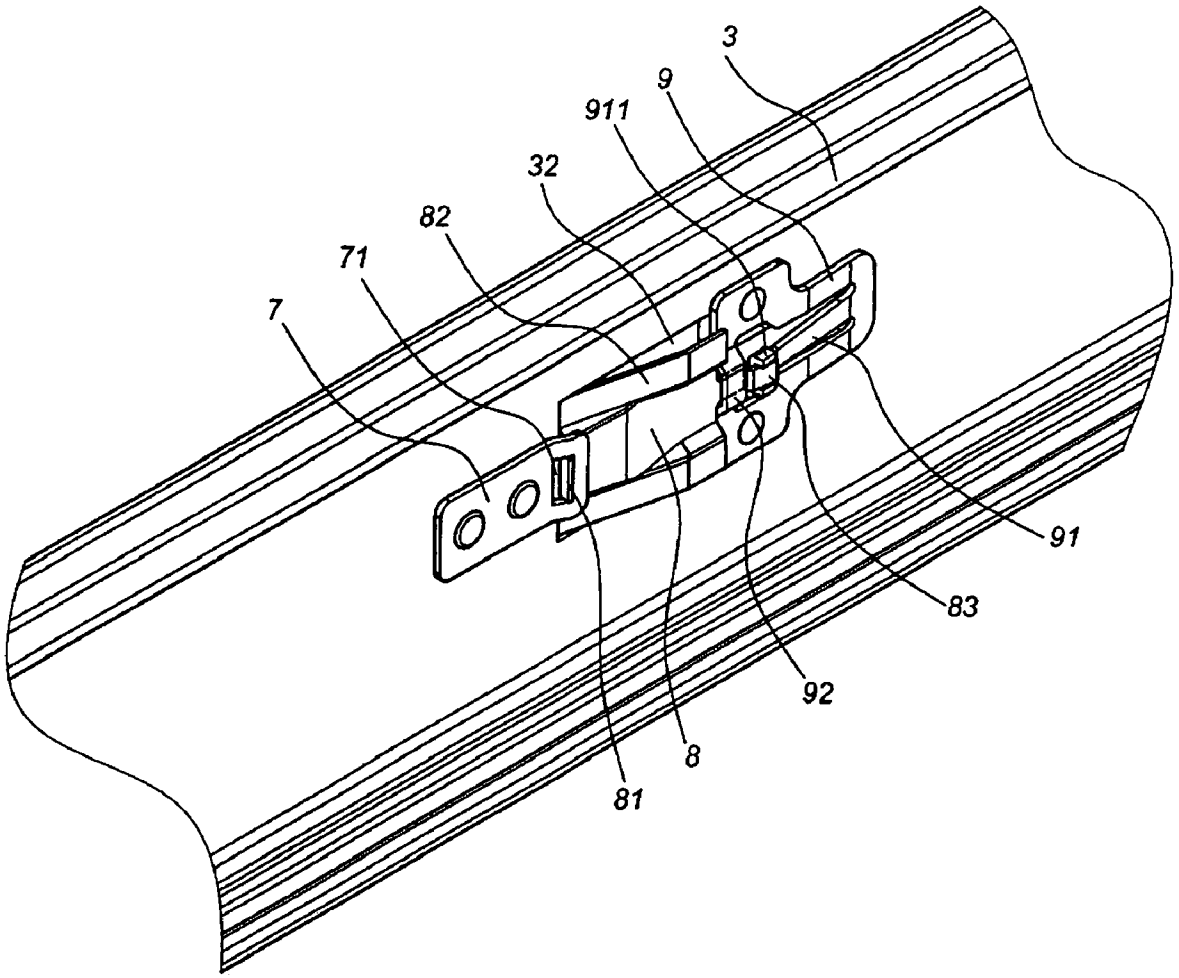
FIG. 5 is an assembled, enlarged perspective view illustrating the resilient retainer assembly of the retaining mechanism mounted on the multi-section slide track assembly in accordance with the first embodiment of the present invention.

Turning now to FIGS. 4 and 5, exploded and assembled perspective views of the resilient retainer assembly of the retaining mechanism for use in the multi-section slide track assembly in accordance with the first embodiment of the present invention are illustrated. In a preferred embodiment, the outer slide track 3 has an operation window 32 which is formed on a predetermined position of the outer slide track 3 where the resilient retainer assembly is installed, as best shown in FIG. 4. The operation window 32 includes a neck portion 33 provided with a relatively narrow width. Furthermore, the operation window 32 further includes a positioning protrusion 321 which is extended on a periphery of the operation window 32.

Constructions of the resilient retainer assembly in the first embodiment shall be described in detail with reference to FIGS. 4 and 5. In the first embodiment, the resilient retainer assembly includes a fixing member 7, a resilient stop member 8 and a limit member 9 which are mounted on the outer slide track 3 by using fasteners, such as rivets, screws or equivalent attachment structures. The fixing member 7 is preferably constructed from a one-piece member which has a receiving hole 71 for mounting the resilient stop member 8. The receiving hole 71 is located at a predetermined position of the fixing member 7 corresponding to the positioning protrusion 321 formed in the operation window 32 of the outer slide track 3.

Still referring to FIGS. 4 and 5, preferably, the resilient stop member 8 is constructed from a one-piece metal member which includes a tail piece 81, a pair of pressing guide edges 82 and a head piece 83. The resilient stop member 8 is relatively rigid and strong to withstand normal usage of the sliding movements of the multi-section slide track assembly. In the illustrated first embodiment, the resilient stop member 8 is designed for having a high degree of resilience in pressing operation. The tail piece 81 is formed with a bent portion which can be engaged in the receiving hole 71 of the fixing member 7. The resilient stop member 8 has two opposite outer edges each connecting with the pressing guide edges 82 which is correspondingly bent on the associated outer edge. Each of the pressing guide edges 82 has a higher end to form a stop portion of the pressing guide edges 82. The head piece 83 is provided on an end side of the resilient stop member 8 opposite to that provided with the tail piece 81. Preferably, the head piece 83 is formed with a bent portion which can be engaged with the limit member 9. In a preferred embodiment, the tail piece 81, the pressing guide edges 82 and the head piece 83 are integrally formed in a single punching or bending operation such that no other bending operation is required.

By referring particularly to FIG. 5, in assembling, a distal end of the fixing member 7 is fixed on one end side of the operation window 32 of the outer slide track 3. In the first embodiment, the tail piece 81 is sandwiched in between the positioning protrusion 321 of the operation window 32 and the fixing member 7 while the bent portion of the tail piece 81 is engaged in the receiving hole 71 of the fixing member 7. In this manner, the receiving hole 71 of the fixing member 7 permits the resilient stop member 8 to generate within a certain extent of the angular movement for engagement or disengagement of the stop portion with or from the engaging lug 52 of the stop-engaging member 5.

Still referring to FIGS. 4 and 5, preferably, the limit member 9 is also constructed from a one-piece metal member which includes a resilient arm 91 and a limiting ring 92. The limit member 9 is relatively rigid and strong to withstand normal usage of the sliding movements of the multi-section slide track assembly. In the illustrated first embodiment, the resilient arm 91 includes a first distal end connected with the limit member 9, and a second distal end provided with an engaging groove 911. The resilient arm 91 is extended along a direction toward the limiting ring 92. In addition, the resilient arm 91 is designed to provide an upward spring force to upraise the head piece 83 of the resilient stop member 8. In a preferred embodiment, the resilient arm 91 and the limiting ring 92 are integrally formed in a single punching or bending operation such that no other bending operation is required.

By referring particularly to FIG. 5, in assembling, the limit member 9 is fixed on another end side of the operation window 32 of the outer slide track 3 opposite to that to mount the resilient stop member 8. Once assembled, the head piece 83 of the resilient stop member 8 is passed through the limiting ring 92, and engaged in the engaging groove 911 of the resilient arm 91 of 20 the limit member 9 in the event. To ensure vertical positions of the stop portions of the resilient stop member 8 with respect to the inner slide track 3, the resilient arm 91 of the limit member 9 continuously exerts a sufficient upward spring force on the head piece 83 of the resilient stop member 8. Accordingly, the spring force of the resilient arm 91 can limit an unexpected downward movement of the head piece 83 of the resilient stop member 8. This ensures a good engagement of the resilient stop member 8 with the stop-engaging member 5, and reduces the chance of an unexpected disengagement of the resilient stop member 8 from the stop-engaging member 5. Conversely, the limiting ring 92 of the limit member 9 can confine a range of the upraised movement of the head piece 83 of the resilient stop member 8.

Figure 6:
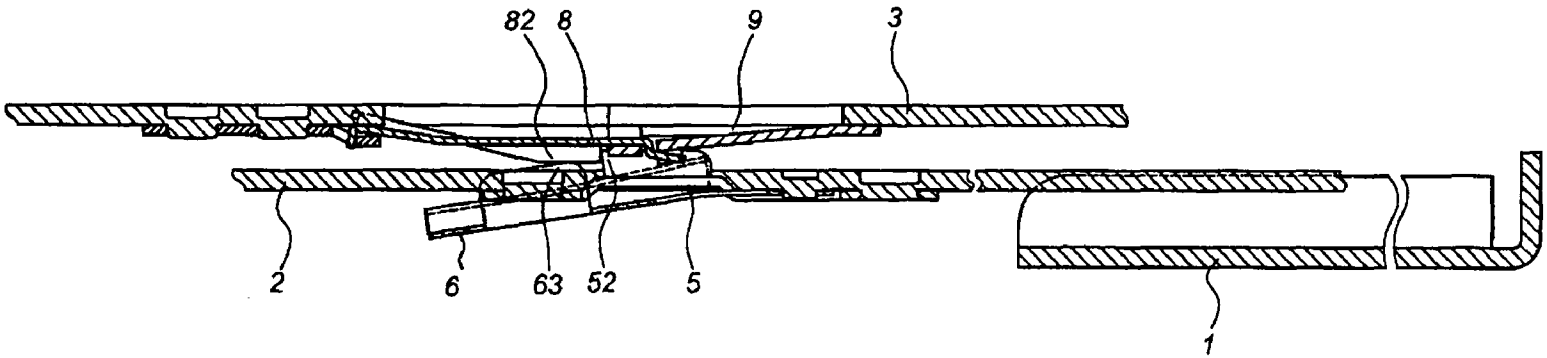
FIG. 6 is a cross-sectional fragmental view illustrating the stop actuating assembly engaging with the resilient retainer assembly of the retaining mechanism in accordance with the first embodiment of the present invention in a full-extended state of an outer slide track and an intermediate slide track of the multi-section slide track assembly.

Turning now to FIG. 6, a cross-sectional view of the stop actuating assembly engaging with the resilient retainer assembly of the retaining mechanism in accordance with the first embodiment of the present invention in a full-extended state of the outer slide track 3 and the intermediate slide track 2 of the multi-section slide track assembly is illustrated. During drawing out the intermediate slide track 2 from the outer slide track 3, the engaging lugs 52 of the stop-engaging member 5 can press and slide along the corresponding pressing guide edges 82 of the resilient stop member 8. If the intermediate slide track 2 is continuously drawn out from the outer slide track 3, the engaging lugs 52 of the stop-engaging member 5 can pass through the corresponding pressing guide edges 82 of the resilient stop member 8 in the event. Once completely drawn out, the engaging lugs 52 of the stop-engaging member 5 are engaged with the associated stop portions provided on the pressing guide edges 82 of the resilient stop member 8 in a reverse direction; namely, an unexpected return movement of the intermediate slide track 2 on the outer slide track 3 along the reverse direction is not allowed.

On the other hand, the actuating lugs 63 of the resiliently actuating member 6 are aligned and engaged with the corresponding pressing guide edges 82 of the resilient stop member 8. Preferably, the pressing guide edges 82 of the resilient stop member 8 can continuously exert their own upward spring force on the actuating lugs 63 of the resiliently actuating member 6 for an upraising movement. In the first embodiment, the pressing guide edges 82 of the resilient stop member 8 due to the resilient force of the resilient arm 91 of the limit member 9 can further exert an additional upward spring force on the actuating lugs 63 of the resiliently actuating member 6 for ensuring an upraising movement. To ensure the engagement of the stop-engaging member 5 with the associated stop portions of the resilient stop member 8, the inner slide track 1, however, does not contact with the resiliently actuating member 6. Nevertheless, it will be understood that the inner slide track 1 can engage with the associated pressing guide edges 62 of the resiliently actuating member 6 in releasing operation when a return movement of the inner slide track 1 along the intermediate slide track 2 occurs.

Figure 7:
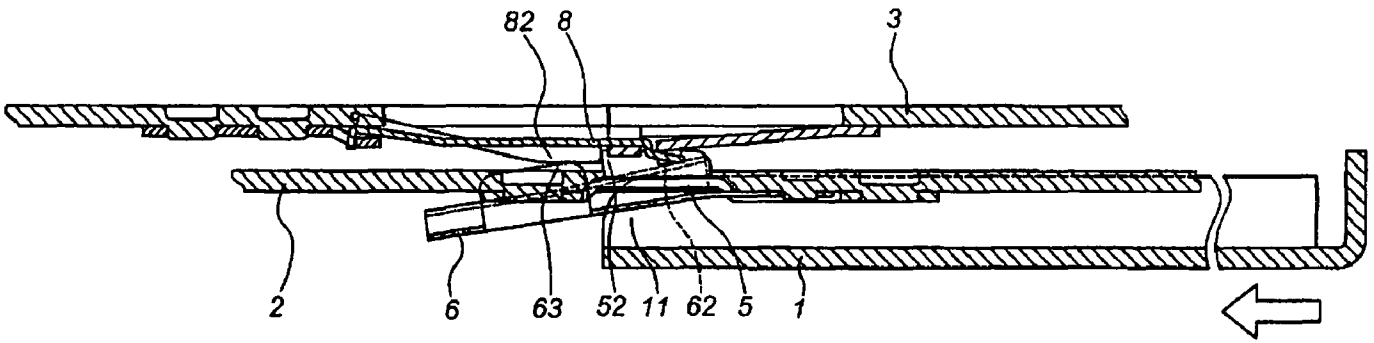
FIG. 7 is a cross-sectional fragmental view illustrating a return movement of an inner slide track of the multi-section slide track assembly for actuating the stop actuating assembly in accordance with the first embodiment of the present invention.

Turning now to FIG. 7, a cross-sectional view of a return movement of the inner slide track 1 of the multi-section slide track assembly for actuating the resiliently actuating member 6 of the stop actuating assembly in accordance with the first embodiment of the present invention is illustrated. In retracting operation, no return movement of the intermediate slide track 2 on the outer slide track 3 along the reverse direction is allowed due to the engagement of the stop portions of the resilient stop member 8 with the engaging lugs 52 of the stop-engaging member 5. The inner slide track 1 is accordingly retracted along the intermediate slide track 2 until the inner slide track 1 is in contact with the pressing guide edges 62 of the resiliently actuating member 6.

Figure 8:
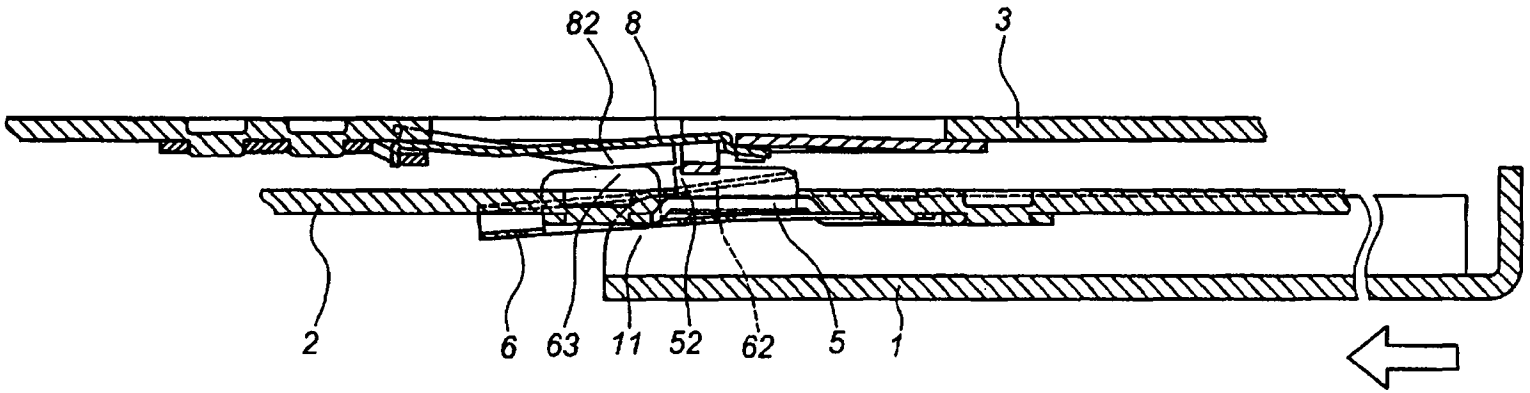
FIG. 8 is a cross-sectional fragmental view illustrating the inner slide track of the multi-section slide track assembly pressing a resiliently actuating member of the stop actuating assembly in accordance with the first embodiment of the present invention in the return movement of the inner slide track.

Turning now to FIG. 8, a cross-sectional view of the inner slide track 1 of the multi-section slide track assembly pressing the resiliently actuating member 6 of the stop actuating assembly in accordance with the first embodiment of the present invention in the return movement of the inner slide track 1 is illustrated. In releasing operation, front side portions of the inner slide track 1 such as bent side edges 11 engage with and press the pressing guide edges 62 of the resiliently actuating member 6 so that the resiliently actuating member 6 is tilted an angular movement. This results in the actuating lugs 63 of the resiliently actuating member 6 synchronously pressing the associated pressing guide edges 82 of the resilient stop member 8. Preferably, the actuating lugs 63 of the resiliently actuating member 6 are designed to easily actuate the pressing guide edges 82 of the resilient stop member 8 such that the engaging lugs 52 of the stop-engaging member 5 are easily disengaged from the stop portions of the resilient stop member 8. If the stop-engaging member 5 is disengaged from the resilient stop member 8, it permits releasing the intermediate slide track 2 from the outer slide track 3 for freely retraction.

Figure 9:
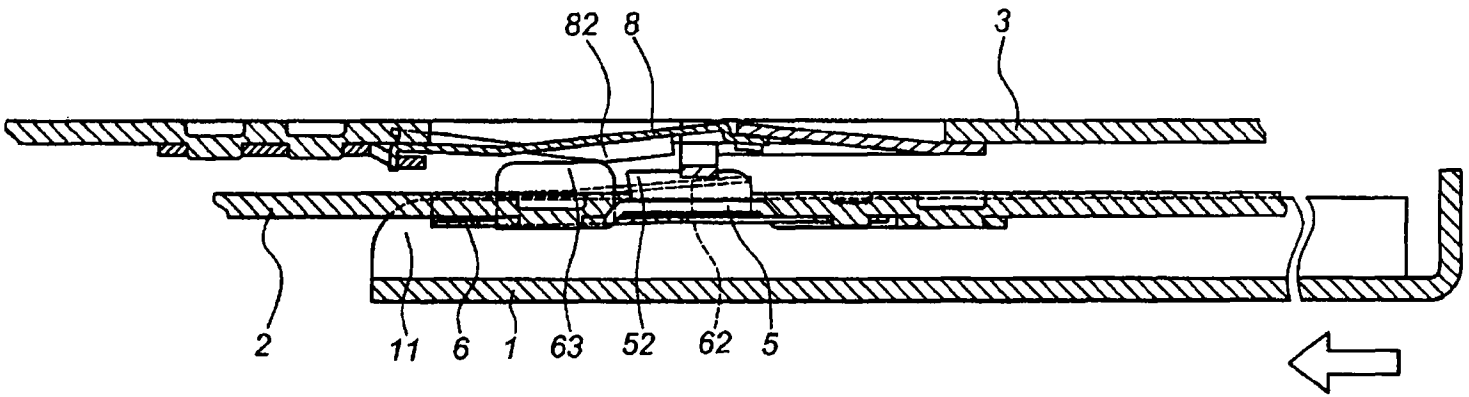
FIG. 9 is a cross-sectional fragmental view illustrating the stop actuating assembly disengaging from the resilient retainer assembly of the retaining mechanism in accordance with the first embodiment of the present invention by the inner slide track of the multi-section slide track assembly fully pressing the resiliently actuating member of the stop actuating assembly.

Turning now to FIG. 9, a cross-sectional view of the stop actuating assembly disengaging from the resilient retainer assembly of the retaining mechanism in accordance with the first embodiment of the present invention by the front side portions of the inner slide track 1 fully pressing the resiliently actuating member 6 is illustrated. Once the bent side edges 11 of the inner slide track 1 fully presses and passes through the associated pressing guide edges 62 of the resiliently actuating member 6, the engaging lugs 52 of the stop-engaging member 5 are completely disengaged from the stop portions of the resilient stop member 8. Consequently, a return movement of the intermediate slide track 2 along the outer slide track 3 is allowed.

Figure 10:
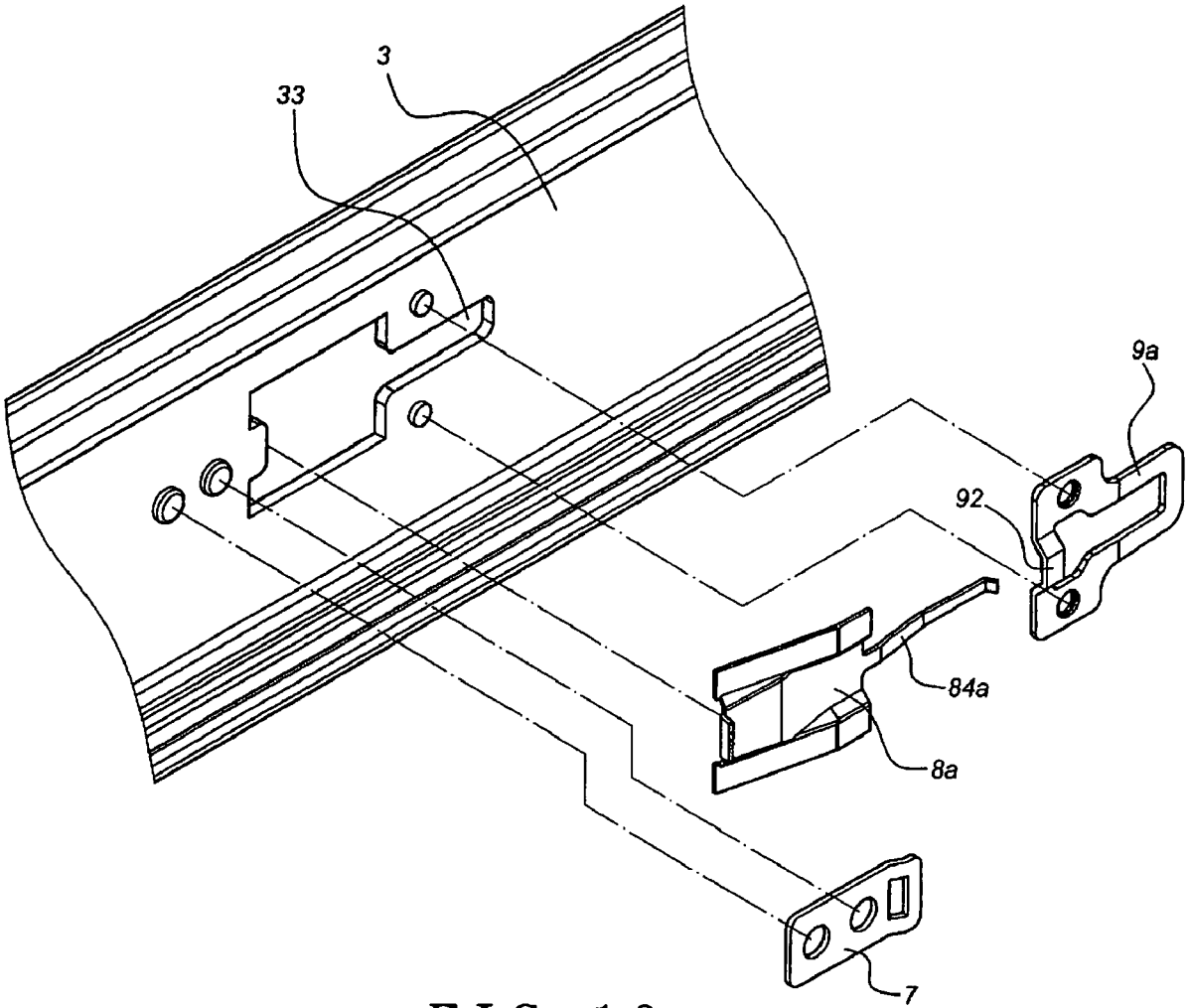
FIG. 10 is an exploded, enlarged perspective view illustrating another resilient retainer assembly of the retaining mechanism for use in the multi-section slide track assembly in accordance with a second embodiment of the present invention.
Figure 11:
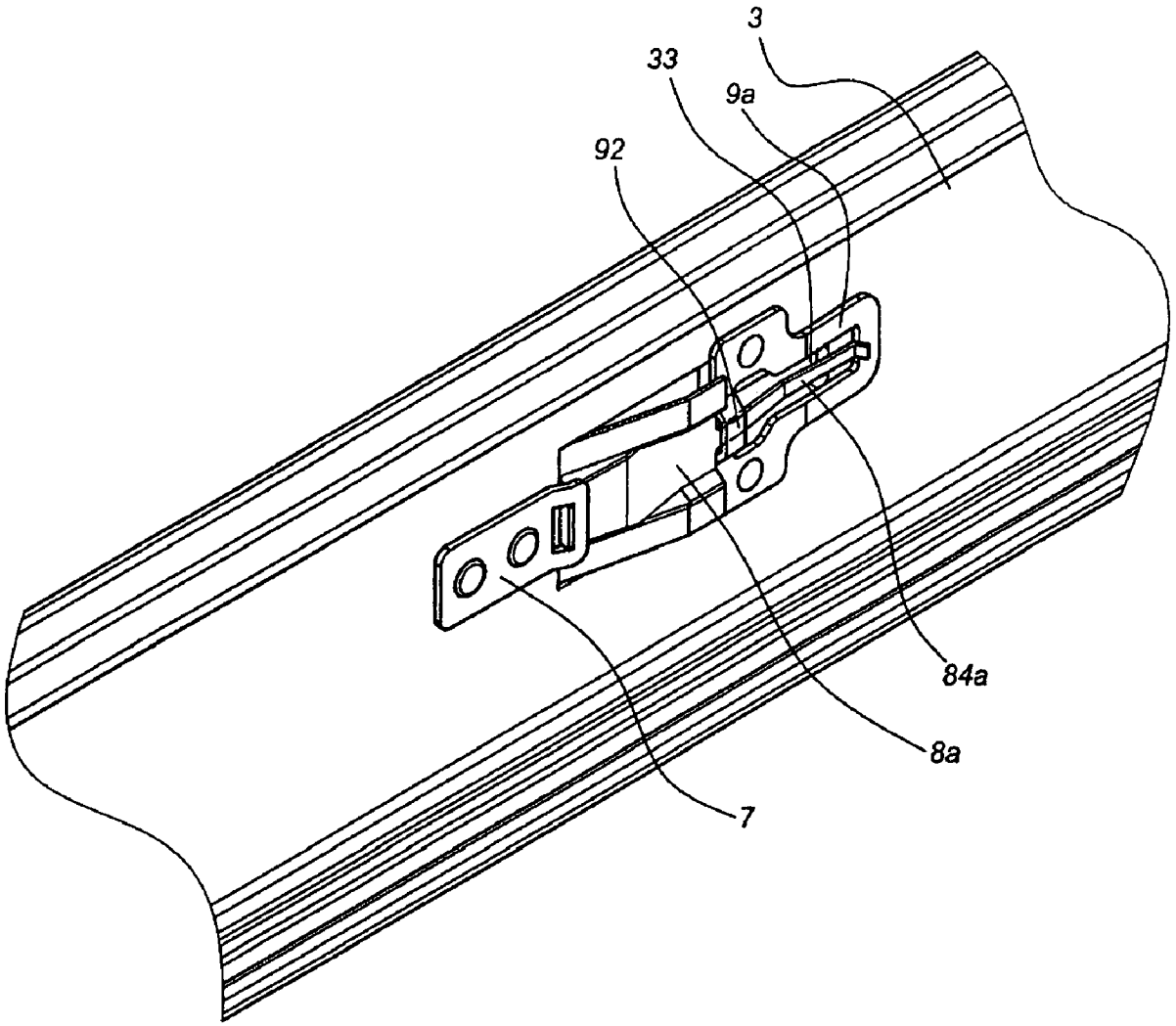
FIG. 11 is an assembled, enlarged perspective view illustrating the resilient retainer assembly of the retaining mechanism mounted on the multi-section slide track assembly in accordance with the second embodiment of the present invention.

Turning now to FIGS. 10 and 11, exploded and assembled perspective views of another resilient retainer assembly of the retaining mechanism for use in the multi-section slide track assembly in accordance with a second embodiment of the present invention are illustrated. In comparison with the first embodiment, the resilient stop member 8*a* of the second embodiment further includes a resilient arm 84*a* integrally formed therewith so as to simplify the entire structure of the resilient retainer assembly. In the second embodiment, the resilient arm 84*a* has a first end connected with the resilient stop member 8*a*, and a second end spaced apart from the resilient stop member 8*a*. The resilient arm 84*a* is designed to provide an upward spring force to upraise the resilient stop member 8. Correspondingly, the limit member 9*a* does not include any resilient arm for further simplifying the entire structure of the resilient retainer assembly. Once installed, the resilient arm 84*a* of the resilient stop member 8*a* is passed through the limiting ring 92. Furthermore, the second end of the resilient arm 84*a* is engaged with a surface of the outer slide track 3 due to pressing by the limiting ring 92 of the limit member 9*a*.

Figure 12:
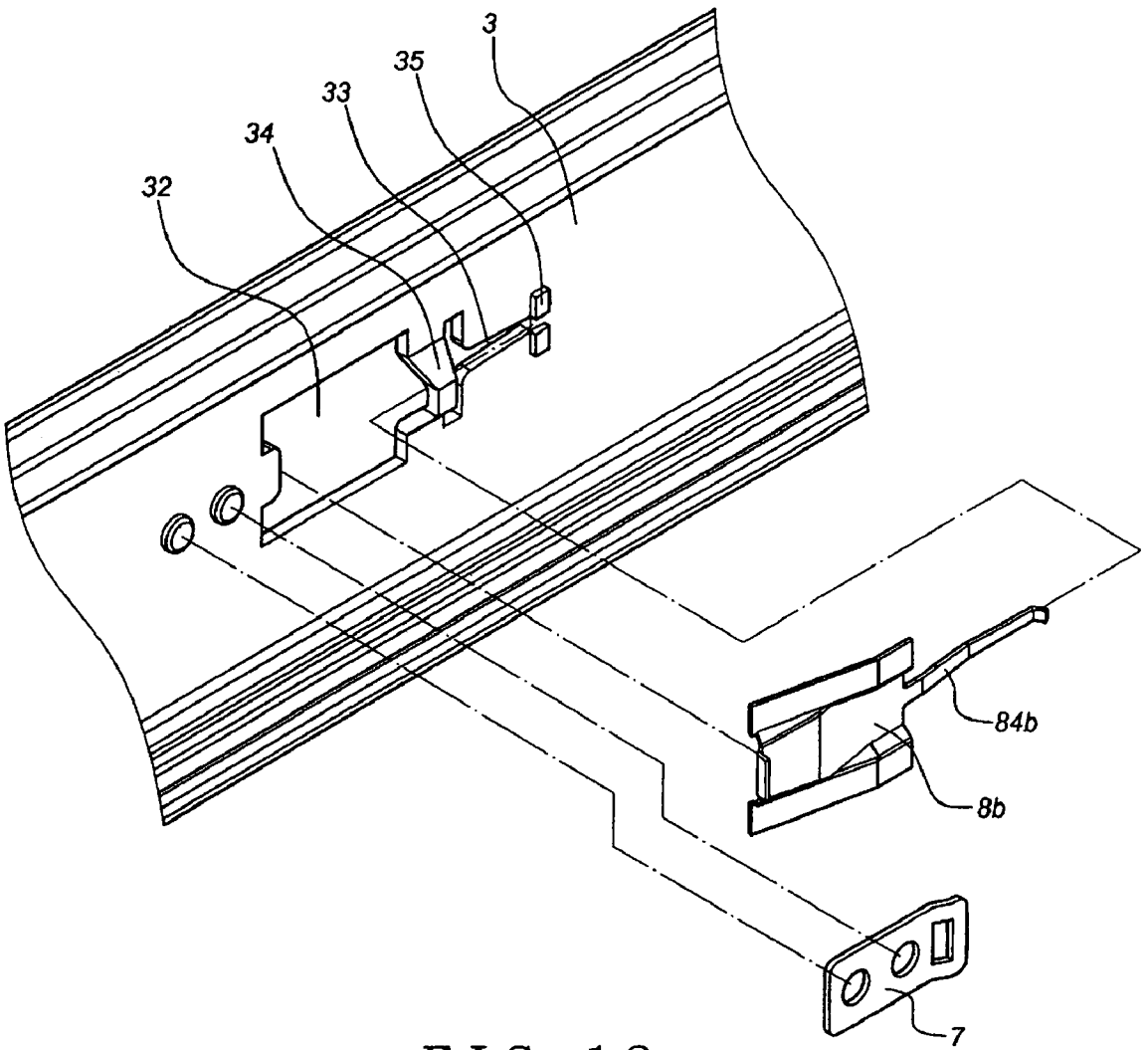
FIG. 12 is an exploded, enlarged perspective view illustrating another resilient retainer assembly of the retaining mechanism for use in the multi-section slide track assembly in accordance with a third embodiment of the present invention.
Figure 13:
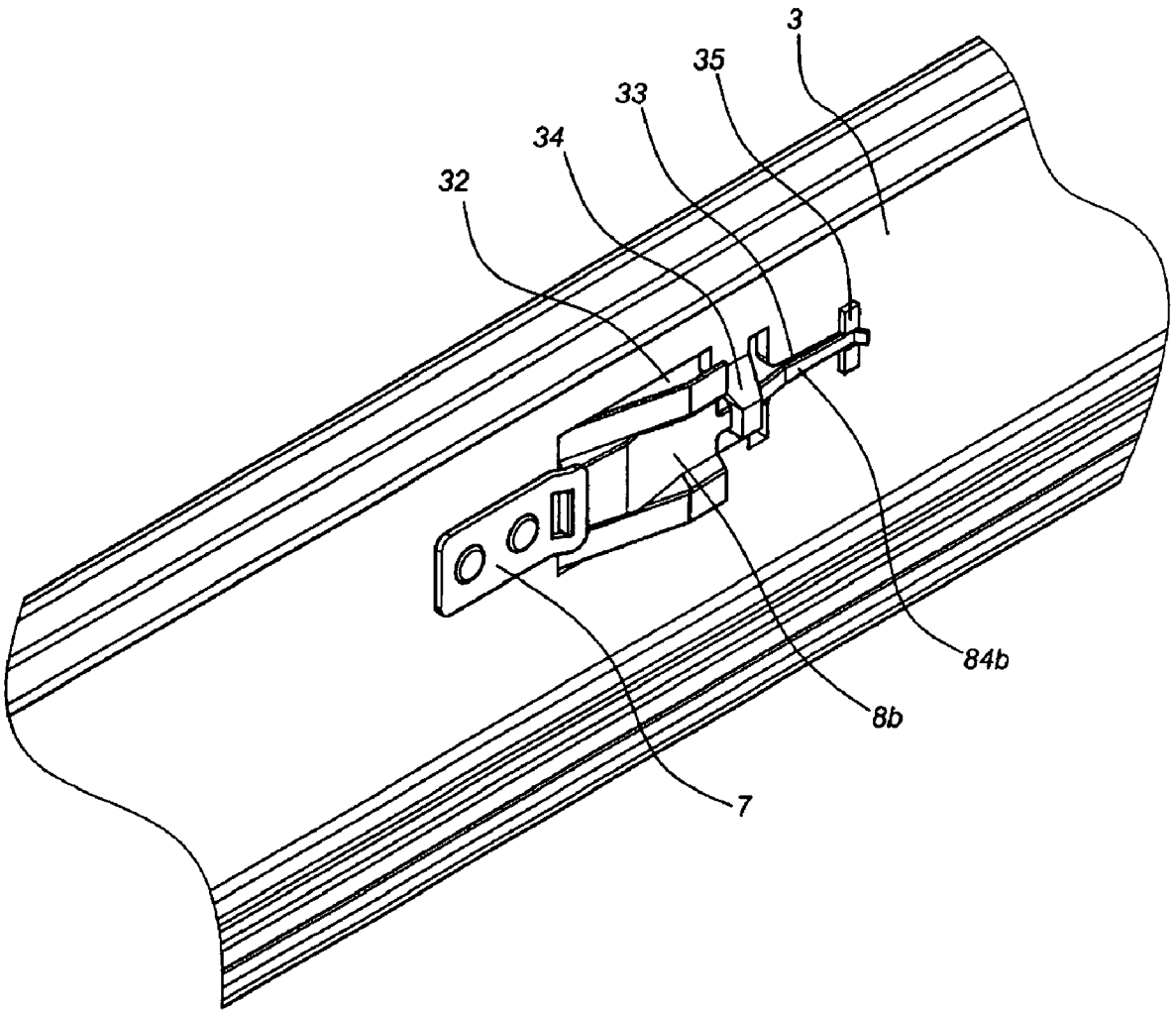
FIG. 13 is an assembled, enlarged perspective view illustrating the resilient retainer assembly of the retaining mechanism mounted on the multi-section slide track assembly in accordance with the third embodiment of the present invention.

Turning now to FIGS. 12 and 13, exploded and assembled perspective views of another resilient retainer assembly of the retaining mechanism for use in the multi-section slide track assembly in accordance with a third embodiment of the present invention are illustrated. In comparison with the first embodiment, the resilient stop member 8*b* of the third embodiment further includes a resilient arm 84*b* integrally formed therewith so as to simplify the entire structure of the resilient retainer assembly. In the third embodiment, the resilient arm 84*b* has a first end connected with the resilient stop member 8*b*, and a second end spaced apart from the resilient stop member 8*b*. Preferably, the outer slide track 3 includes a limiting ring 34 and a pair of upraised protrusions 35 integrally formed therewith. Once installed, the resilient arm 84*b* of the resilient stop member 8*b* is passed through the limiting ring 34, and the second end of the resilient arm 84*b* is engaged in the upraised protrusions 35 formed on the outer slide track 3. Consequently, a lateral movement of the resilient arm 84*b* of the resilient stop member is limited.

Figure 14:
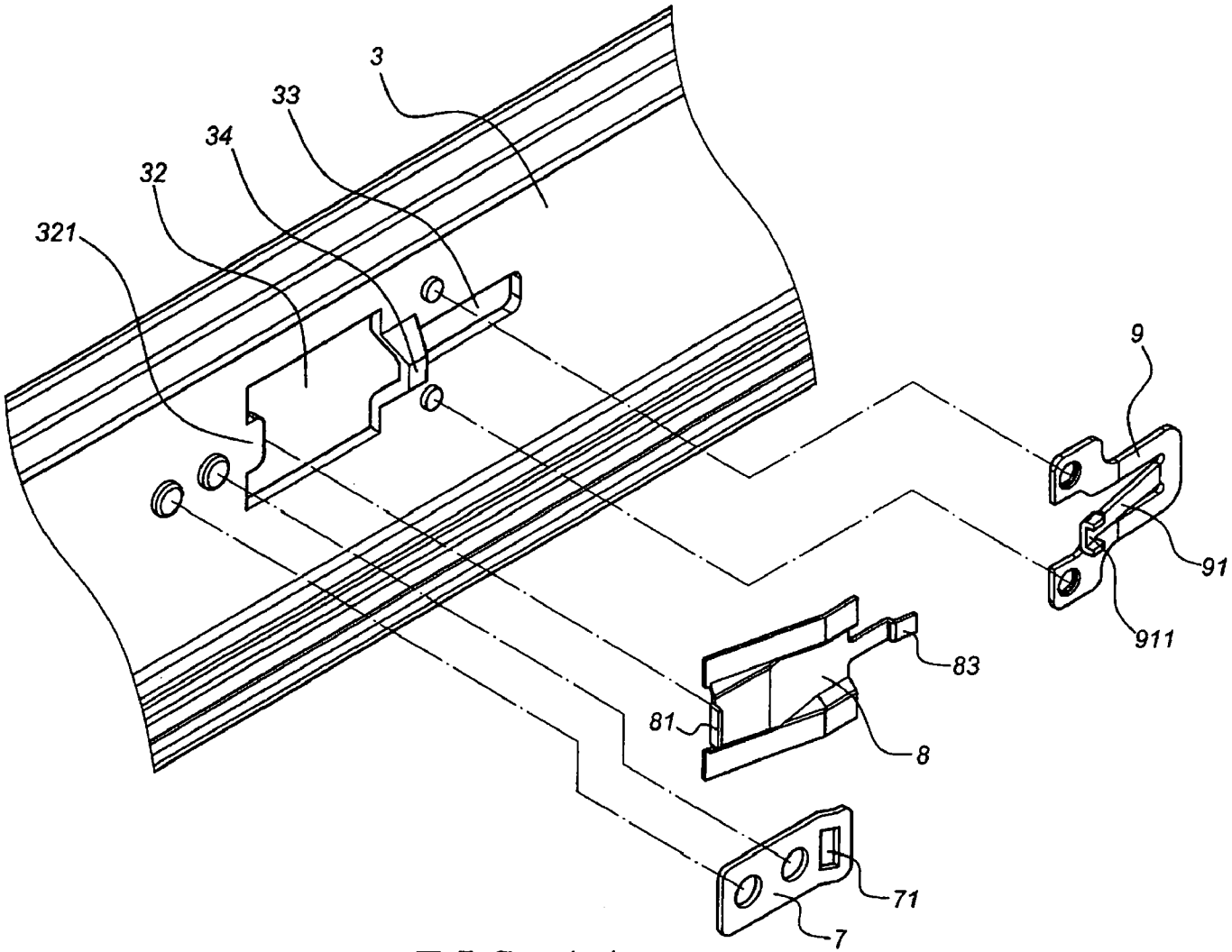
FIG. 14 is an exploded, enlarged perspective view illustrating another resilient retainer assembly of the retaining mechanism for use in the multi-section slide track assembly in accordance with a fourth embodiment of the present invention.
Figure 15:
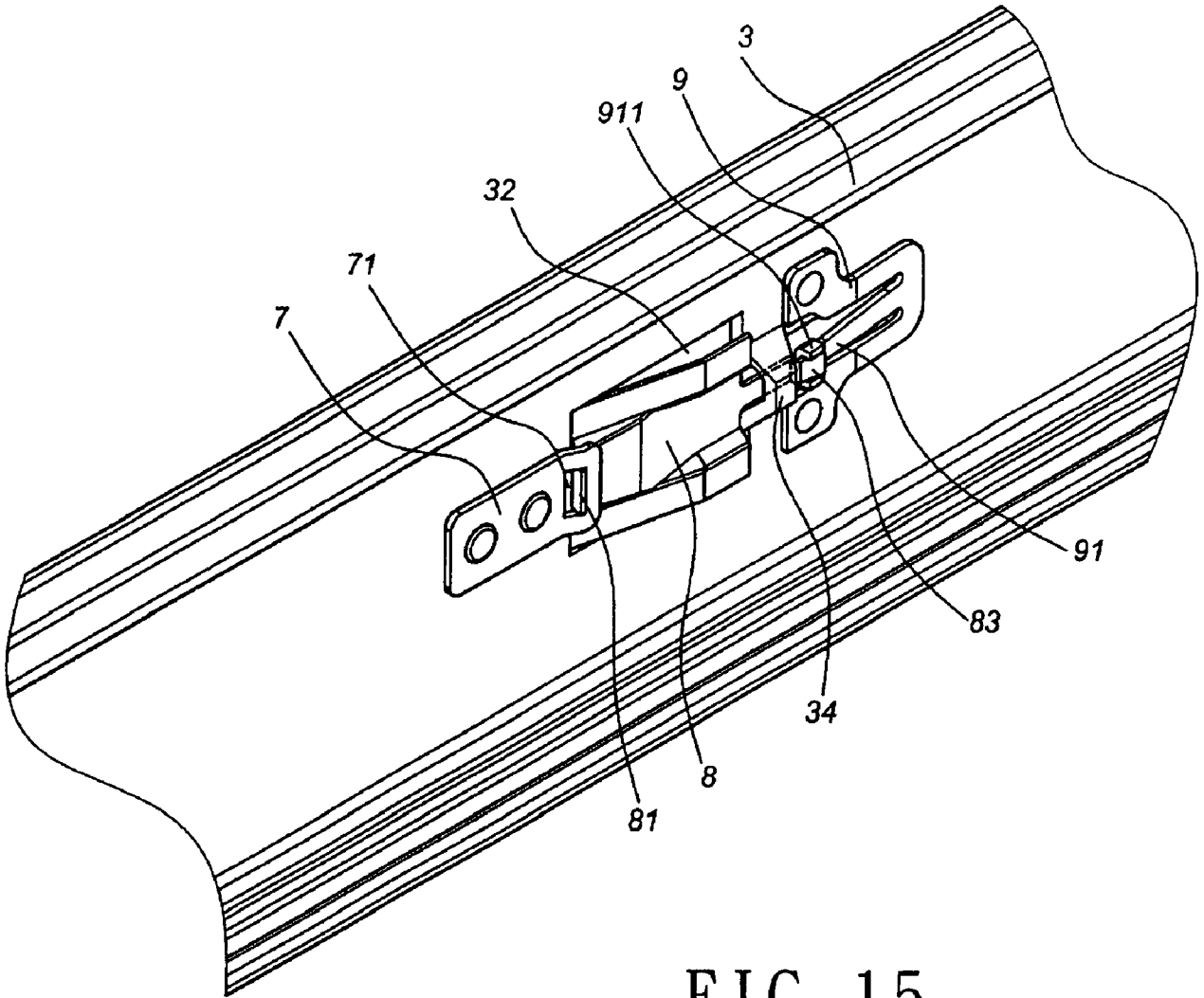
FIG. 15 is an assembled, enlarged perspective view illustrating the resilient retainer assembly of the retaining mechanism mounted on the multi-section slide track assembly in accordance with the fourth embodiment of the present invention.

Turning now to FIGS. 14 and 15, exploded and assembled perspective views of another resilient retainer assembly of the retaining mechanism for use in the multi-section slide track assembly in accordance with a fourth embodiment of the present invention are illustrated. The resilient stop member 8 of the fourth embodiment includes the complete structure of the tail piece 81, the pressing guide edges 82 and the head piece 83. In comparison with the first embodiment, the limit member 9 of the fourth embodiment does not include any limiting ring for further simplifying the entire structure of the resilient retainer assembly. In this way, the operation window 32 of the outer slide track 3 of the fourth embodiment includes a limiting ring 34 to limit an upward movement of the head piece 83 of the resilient stop member 8. The limiting ring 34 of the outer slide track 3 is corresponding to the resilient arm 91 of the limit member 9. Once installed, the head piece 83 of the resilient stop member 8 is passed through the limiting ring 34, and is engaged in the engaging groove 911 of the resilient arm 91 of the limit member 9.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A multi-section slide track assembly, comprising:

an outer slide track;

an intermediate slide track slidably connected to the outer slide track and having at least one operation window;

an inner slide track slidably connected to the intermediate slide track;

a stop-engaging member mounted on the intermediate slide track and having at least one engaging lug extended through the operation window of the intermediate slide track;

a resiliently actuating member mounted on the intermediate slide track and including at least one actuating lug extended through the operation window of the intermediate slide track, a first resilient arm providing a spring force, and at least one first pressing guide edge being pressed by the inner slide track for releasing operation;

a resilient stop member mounted on the outer slide track and including a second resilient arm providing an upward spring force so as to upraise the resilient stop member, and at least one second pressing guide edge being pressed by the resiliently actuating member and including an end to form a stop portion to engage with the engaging lug of the stop-engaging member such that a return movement of the intermediate slide track is limited;

a limiting ring disposed on the outer slide track to confine a range of an upward movement of the second resilient arm of the resilient stop member;

wherein when the intermediate slide track is fully extended from the outer slide track, the stop portion of the resilient stop member is engaged with the engaging lug of the stop-engaging member;

wherein when the inner slide track is retracted along the intermediate slide track to press the first pressing guide edge of the resiliently actuating member in a return movement, the actuating lug of the resiliently actuating member presses the second pressing guide edge of the resilient stop member such that the stop portion of the resilient stop member is disengage from the engaging lug of the stop-engaging member; and wherein the second resilient arm of the resilient stop member is passed through the limiting ring, and an end of the second resilient arm is engaged with a surface of the outer slide track due to pressing by the limiting ring of the limit member.

2. The multi-section slide track assembly as defined in claim 1, further including a fixing member mounted on the outer slide track and a receiving hole formed on the fixing member; with the resilient stop member correspondingly including a tail piece engaged in the receiving hole of the fixing member.

3. The multi-section slide track assembly as defined in claim 1, wherein the stop-engaging member further includes a recess section which is received in the operation window of the intermediate slide track when assembled.

4. The multi-section slide track assembly as defined in claim 1, wherein the outer slide track further includes an operation window and a positioning protrusion thereof, the resilient stop member is sandwiched in between a fixing member and the positioning protrusion of the operation window.

5. The multi-section slide track assembly as defined in claim 1, wherein the limiting ring being integrally formed on the outer slide track.

6. The multi-section slide track assembly as defined in claim 1, further comprising a limiting member mounted on the outer slide track and the limiting ring being integrally formed on the limiting member.

7. The multi-section slide track assembly as defined in claim 1, further comprising a pair of upraised protrusions integrally formed on the outer slide track to limit a lateral movement of the second resilient arm of the resilient stop member.

* * * * *